United States Patent [19]

Rabus et al.

[11] 4,114,582

[45] Sep. 19, 1978

[54] VOLTAGE LIMITED IGNITION SYSTEM, PARTICULARLY FOR AN INTERNAL COMBUSTION ENGINE

[75] Inventors: Friedrich Rabus, Schwieberdingen; Josef Wahl, Stuttgart; Günter Gräther, Pinache, all of Fed. Rep. of Germany

[73] Assignee: Robert Bosch GmbH, Stuttgart, Fed. Rep. of Germany

[21] Appl. No.: 776,739

[22] Filed: Mar. 11, 1977

[30] Foreign Application Priority Data

Apr. 6, 1976 [DE] Fed. Rep. of Germany ..... 2614780

[51] Int. Cl.[2] ..... F02P 11/00; F02P 1/00

[52] U.S. Cl. ..... 123/148 E; 123/148 S; 361/91; 361/263

[58] Field of Search ..... 123/148 E, 148 S; 324/126; 361/86, 91, 256, 263

[56] References Cited

U.S. PATENT DOCUMENTS

| | | | |
|---|---|---|---|
| 3,458,764 | 7/1969 | Gertsch et al. | 361/86 |
| 3,513,353 | 8/1967 | Lansch | 361/86 |
| 3,710,192 | 1/1973 | Budlane | 361/256 |
| 3,889,159 | 6/1975 | Wessel | 361/86 |
| 3,947,725 | 3/1976 | Lucas | 324/126 |
| 4,056,838 | 11/1977 | Leib | 361/86 |

FOREIGN PATENT DOCUMENTS

| | | | |
|---|---|---|---|
| 1,269,719 | 6/1968 | Fed. Rep. of Germany | 324/126 |
| 591,073 | 8/1947 | United Kingdom | 324/126 |

*Primary Examiner*—Charles J. Myhre
*Assistant Examiner*—P. S. Lall
*Attorney, Agent, or Firm*—Flynn & Frishauf

[57] ABSTRACT

To prevent application of excessive spark energy in an ignition system designed for proper firing voltages even under low-battery voltage conditions, upon rise of the battery voltage to normal or excessive values, a voltage sensing circuit, including a threshold stage, is connected to the secondary of the ignition coil to sense the secondary voltage, the threshold stage providing an output when the voltage is exceeded and blocking continued supply of power to the ignition coil of the system to thereby limit the ignition voltage.

10 Claims, 1 Drawing Figure

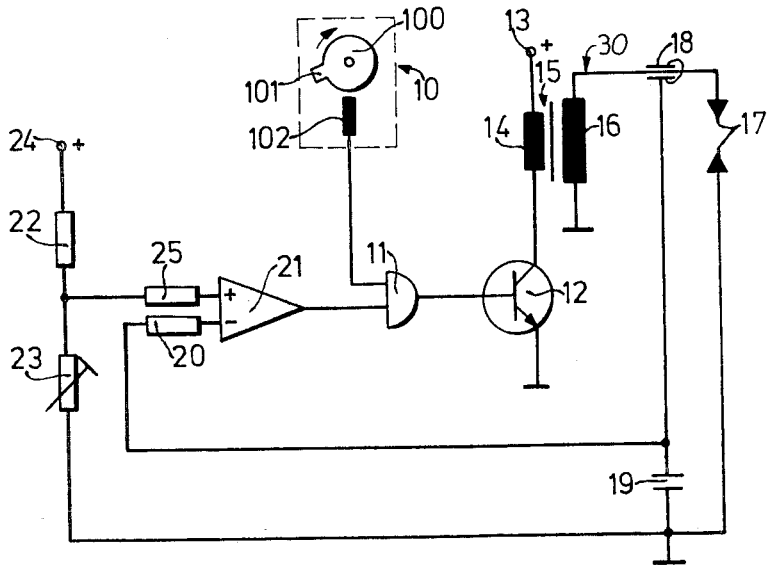
100
13
30
18
101
10
15
17
24
102
14
16
22
25
21
11
12
23
20
19

VOLTAGE LIMITED IGNITION SYSTEM, PARTICULARLY FOR AN INTERNAL COMBUSTION ENGINE

Cross reference to related application: U.S. Ser. No. 776,735, filed Mar. 11, 1977, Gräther, (claiming priority of German Application P 26 11 596.8 of Mar. 19, 1976; Attorney Docket Ff 6501; R. 3143) assigned to the assignee of the present application.

The present invention relates to an ignition system for an internal combustion engine, and more particularly to such a system having an arrangement to limit the ignition voltage.

Many ignition systems for use in automotive-type internal combustion engines have an ignition coil, the secondary of which is connected with the spark gap of a spark plug. The primary of the ignition coil is controlled by a switch. An ignition control system is connected to the switch to provide for accurate timing of the operation thereof.

Usually, ignition systems are so dimensioned that ignition will occur even under unfavorable operating conditions. One of the unfavorable operating conditions which frequently occurs is, for example, low battery voltage due to poor condition of the battery or due to low temperature; or, for example, due to high secondary loading because of high ignition cable or ignition wiring capacity, or low spark plug resistance. The ignition system therefore must be dimensioned to accept unfavorable operating conditions, with the result that, if the operating conditions are good, excessively high voltages can occur at the secondary of the ignition coil. For example, if the battery voltage is normal or slightly high, extremely high voltage pulses may arise at the secondary of the coil if no ignition event should occur, for example due to cable interruption, or other malfunction. Such a misfire can arise due to interruption of the connection to the spark gap, particularly to the spark plug due to a cable break, damage to the electrodes of the spark plug, excessive gap between the electrodes of the spark plug, or the like. The secondary voltages which then will arise across the ignition coil may be a multiple of the usually required ignition voltages, resulting in dangerous loading for the various control elements as well as for the insulation. Arc-over may result, leading to damage of the ignition system and even to its failure, or destruction.

It is an object of the present invention to protect the ignition system upon failure of an ignition event to occur against excessively high currents and voltages.

SUBJECT MATTER OF THE PRESENT INVENTION

Briefly, a voltage measuring or voltage sensing circuit is included in the secondary circuit of the ignition coil and so connected that a threshold stage is enabled when the voltage sensed rises above a value of which the threshold level of the threshold stage is representative. The threshold stage is connected to a switching element which blocks the interrupter switch connected to the ignition system if the threshold level thereof is exceeded.

In accordance with a feature of the invention, a voltage measuring arrangement which is particularly simple and hence desirable is obtained by providing a capacitative voltage divider, connected in parallel to the spark gap of the spark plug, and using a portion of the ignition cable as one capacitor of the capacitative voltage divider. The interrupter switch is then blocked, in accordance with another embodiment of the invention, by providing an AND-gate to which the threshold stage normally applies an opening or passing signal, unless the threshold level of the threshold stage has been exceeded.

The system of the present invention has the advantage that, if ignition should fail, the various components of the ignition system are protected from excessively high currents and voltages. The circuit can thus be used simply and reliably as an overvoltage safety circuit for various types of ignition systems.

DRAWINGS

Illustrating an example, wherein the single figure shows a schematic circuit diagram of the over-voltage protection system connected to an automotive-type ignition system, in which all components not necessary for an understanding of the present invention have been omitted.

An ignition pulse control system 10 is connected over an AND-gate 11 with the control input of an electrical switch 12, typically formed as a transistor switch. The ignition control system 10 can be of any suitable type, for example a breaker, contact, or a contactless transducer. The control system is coupled with the crankshaft of the internal combustion (IC) engine with which the ignition system is used. It may, for example, consist of a disk 100 formed with a cam, projection, or other magnetic discontinuity 101. Upon rotation of the crankshaft, or a shaft coupled thereto, an inductive voltage is induced in transducer pick-up 102. The induced signal can be wave-shaped in a suitable circuit, for example a Schmitt trigger (not shown) in order to provide determined and readily sensed rising and trailing flanks to the signal. Other circuits and components can be connected thereto, for example circuits and systems to change the ignition timing in dependence on an operating or environmental parameter of the IC engine. Such additional ignition timing systems are known and have been omitted from the drawing for clarity.

A source of supply connected between terminal 13 and ground or chassis supplies power to primary winding 14 of ignition coil 15 which is serially connected with the main switching path of transistor switch 12. The secondary 16 of the ignition coil 15 is connected to the spark gap 17, typically to a spark plug of the IC engine. A distributor, for use with multi-cylinder engines may be used, but has been omitted from the drawing for clarity. One of the electrodes of the spark plug 17 is connected to chassis.

In accordance with the invention, a voltage divider is connected in parallel to the spark gap 17. The voltage divider, in accordance with a preferred feature of the invention, comprises two capacitors 18, 19. Capacitor 18 must be a highvoltage capacitor, that is, must be capable of resisting high voltage levels. Its capacity can be several pF. Capacitor 18, preferably, is so constructed that a portion of the outside of the ignition cable 30 has a metallic coating, sleeve, or other electrode material applied thereto forming one electrode of capacitor 18, connected to the second capacitor 19.

The core wire of the ignition cable forms the other electrode of capacitor 18. Other voltage dividers, for example an ohmic voltage divider, or one of another type, may be used.

The junction point of the voltage divider, in the illustration the junction of the two capacitors 18, 19, is connected through a resistor 20 to the inverting input of an operational amplifier 21. Operational amplifier 21 is connected as a threshold circuit. A second voltage divider, formed of two resistors 22, 23, is connected between a source 24 of preferably stabilized voltage, and ground or chassis. Resistor 23, preferably, is adjustable, as shown. The junction between resistors 22, 23 is connected over a further coupling resistor 25 to the direct input of operational amplifier 21, the output of which is connected to the second input of the AND-gate 11.

Operation: The system operates in its protective mode by substantially decreasing the secondary voltage of the ignition coil 15. The voltage divided sensed voltage which appears across capacitor 19 is applied to threshold stage 21. The threshold value of stage 21 can be set by changing the adjustable resistor 23 to a desired, suitable value. So long as the voltage across the capacitor 19 is below the set threshold value, that is, at a level at which the secondary voltage of the ignition coil is below a permissible value, the output of threshold stage 21 will have a signal appear thereat which enables the AND-gate 11 to pass signals from the ignition control system 10 to switch 12. If the secondary voltage from coil 16 exceeds the predetermined value, the threshold of the threshold stage 21 is likewise exceeded and the signal at the output of operational amplifier 21 will go to zero, thus causing AND-gate 11 to block. Blocking of AND-gate 11 blocks transmission of further enabling voltages to the transistor switch 12 so that further rise in the voltage of the ignition coil 15 is prevented.

The system is particularly applicable to ignition arrangements in which the ignition coil 15 is connected as a transformer. In a transformer connection, the secondary voltage rises during change in current through the primary until saturation occurs. During this rise of secondary voltage, ignition across the spark gap 17 will result as soon as the voltage has reached a certain value. The secondary voltage collapses when the spark arcs over across the electrodes of spark plug 17. If, however, no ignition should take place due to malfunction, as referred to above, the secondary voltage may still continue to rise until saturation is reached, or until current through the primary is interrupted. Further rise in the secondary ignition voltage can occur, however, in accordance with the present invention, only until the threshold of threshold stage 21 is reached. At this point, transistor switch 12 will block and the primary current through coil 15 is interrupted. Further rise of secondary voltage is no longer possible. The threshold level of the threshold stage 21 can be adjusted. Preferably, it is so set that the secondary voltage of the coil 15 can rise above the value in which ignition will still occur even under unfavorable operating conditions. Under ordinary conditions, therefore, that is, barring any malfunction, the system to limit the ignition voltage is thus not placed in operation.

The system is particularly suitable in ignition systems having variable timing control and especially in systems in which a sequence or plurality of ignition pulses are provided, since in such systems a voltage charge accumulation may occur across the spark gap 17. Such systems may be used, for example, with an additional frequency generator to generate a sequence of ignition pulses for any one ignition event, and reference is herein made to co-pending application Ser. No. 776,735, filed Mar. 11, 1977 Grather.

Various changes and modifications may be made within the scope of the inventive concept.

We claim:

1. Voltage limited ignition system to provide an ignition pulse to a spark gap (17), particularly the spark plug of an externally ignited internal combustion engine having an ignition coil (15), the secondary (16) of which is connected to the spark gap (17);

a controlled switch (12) serially connected to the primary (14) of the coil;

ignition control means (10) controlling opening and closing of the switch (12) to control flow through the coil and hence generation of ignition voltage at the secondary thereof;

and comprising, in accordance with the invention, a voltage sensing circuit (18, 19) including a threshold stage (21) connected to the secondary (16) of the coil (15) and sensing the secondary voltage, the threshold stage providing an output signal when a predetermined secondary voltage is exceeded;

and blocking means (11) controlled by the output signal from the threshold stage (21) and connected to block supply of power to the spark gap when the threshold level of the threshold stage has been exceeded.

2. System according to claim 1, wherein the blocking means (11) is connected to the controlled switch (12) to disable said switch.

3. System according to claim 1, wherein the voltage sensing circuit (18, 19) is a voltage divider connected in parallel to the spark gap (17).

4. System according to claim 1, wherein the voltage sensing circuit is a capacitative voltage divider (18, 19) connected in parallel to the spark gap.

5. System according to claim 4, wherein the capacitative voltage divider comprises a capacitor (19) and a portion of the ignition cable of the ignition system, said portion of the ignition cable forming another capacitor of the capacitative voltage divider.

6. System according to claim 1, wherein the threshold level of the threshold stage (11) is adjustable.

7. System according to claim 6, further comprising a second voltage divider (22, 23) connected to the threshold stage (21) to set or adjust the threshold level thereof.

8. System according to claim 1, wherein the blocking means (11) is a logic gate having its output connected to the controlled switch (12) and having one input connected to the output of the threshold stage (21) and another input to the ignition control means (10).

9. System according to claim 8, wherein the logic gate (11) is an AND-gate and the threshold stage (21) provides an output signal to the AND-gate when the input to the threshold stage is below said predetermined voltage.

10. System according to claim 9, wherein the voltage sensing circuit is a capacitative voltage divider including a capacitor (19) and a portion of the ignition cable connected to the spark gap (17), said portion forming another capacitor of the capacitative voltage divider;

and means (22, 23) connected to said threshold stage to adjustably set the threshold level of said threshold stage and thus determine the predetermined voltage.

* * * * *